US005178418A

United States Patent [19]

Merry et al.

[11] Patent Number: 5,178,418

[45] Date of Patent: Jan. 12, 1993

[54] LATENT IMAGES COMPRISING PHASE SHIFTED MICRO PRINTING

[75] Inventors: Trevor Merry, Nepean; Alan R. Boate, Gloucester, both of Canada

[73] Assignee: Canadian Bank Note Co., Ltd., Ontario, Canada

[21] Appl. No.: 720,392

[22] Filed: Jun. 25, 1991

[51] Int. Cl.[5] ..... B42D 15/00

[52] U.S. Cl. ..... 283/73; 283/901; 380/55

[58] Field of Search ..... 283/67, 901, 73, 94, 283/117; 380/51, 54, 55

[56] References Cited

U.S. PATENT DOCUMENTS 3,675,948 7/1972 Wicker ..... 283/901 X 4,998,010 3/1991 Chandler et al. ..... 283/901 X

*Primary Examiner*—Timothy V. Eley

*Assistant Examiner*—William Fridie, Jr.

*Attorney, Agent, or Firm*—Wood, Phillips, VanSanten, Hoffman & Ertel

[57] ABSTRACT

A security device comprising a substrate having applied thereto an array of characters, the characters being of a sufficiently small size as to appear uniform when ordinarily viewed but individually identifiable when viewed with the aid of appropriate magnification means, whereby group(s) of the characters are phase-shifted relative to the others in such a manner as to collectively define an image, the image being relatively indiscernible when the device is ordinarily viewed but discernible when viewed with the aid of a finding screen.

13 Claims, 8 Drawing Sheets

ROPLEXCANADIANBANKNOTEMICROPLEXCANADIANBANKNOTEMICROPLEXCANADIANBANKNOTEMICROPLEXCANADIANBANKN

IICROPLEXCANADIANBANKNOTEMICROPLEXCANADIANBANKNOTEMICROPLEXCANADIANBANKNOTEMICROPLEXCANADIANBANI

TEMICROPLEXCANADIANBANKNOTEMICROPLEXCANADIANBANKNOTEMICROPLEXCANADIANBANKNOTEMICROPLEXCANADIAN

ROPLEXCANADIANBANKNOTEMICROPLEXCANADIANBANKNOTEMICROPLEXCANADIANBANKNOTEMICROPLEXCANADIANBANKN

IKNOTEMICROPLEXCANADIANBANKNOTEMICROPLEXCANADIANBANKNOTEMICROPLEXCANADIANBANKNOTEMICROPLEXCANAD

IICROPLEXCANADIANBANKNOTEMICROPLEXCANADIANBANKNOTEMICROPLEXCANADIANBANKNOTEMICROPLEXCANADIANBANI

JKNOTEMICROPLEXCANADIANBANKNOTEMICROPLEXCANADIANBANKNOTEMICROPLEXCANADIANBANKNOTEMICROPLEXCANAD

ANADIANBANKNOTEMICROPLEXCANADIANBANKNOTEMICROPLEXCANADIANBANKNOTEMICROPLEXCANADIANBANKNOTEMICRO

EXCANADIANBANKNOTEMICROPLEXCANADIANBANKNOTEMICROPLEXCANADIANBANKNOTEMICROPLEXCANADIANBANKNOTEM

NKNOTEMICROPLEXCANADIANBANKNOTEMICROPLEXCANADIANBANKNOTEMICROPLEXCANADIANBANKNOTEMICROPLEXCANA

CANADIANBANKNOTEMICROPLEXCANADIANBANKNOTEMICROPLEXCANADIANBANKNOTEMICROPLEXCANADIANBANKNOTEMIC

BANKNOTEMICROPLEXCANADIANBANKNOTEMICROPLEXCANADIANBANKNOTEMICROPLEXCANADIANBANKNOTEMICROPLEXCA

MICROPLEXCANADIANBANKNOTEMICROPLEXCANADIANBANKNOTEMICROPLEXCANADIANBANKNOTEMICROPLEXCANADIANBA

EXCANADIANBANKNOTEMICROPLEXCANADIANBANKNOTEMICROPLEXCANADIANBANKNOTEMICROPLEXCANADIANBANKNOTEM

PROPLEXCANADIANBANKNOTEMICROPLEXCANADIANBANKNOTEMICROPLEXCANADIANBANKNOTEMICROPLEXCANADIANBANK

FIG. 1

SCHEMATIC REPRESENTATION OF COMPUTER GENERATION PROCESS

A.

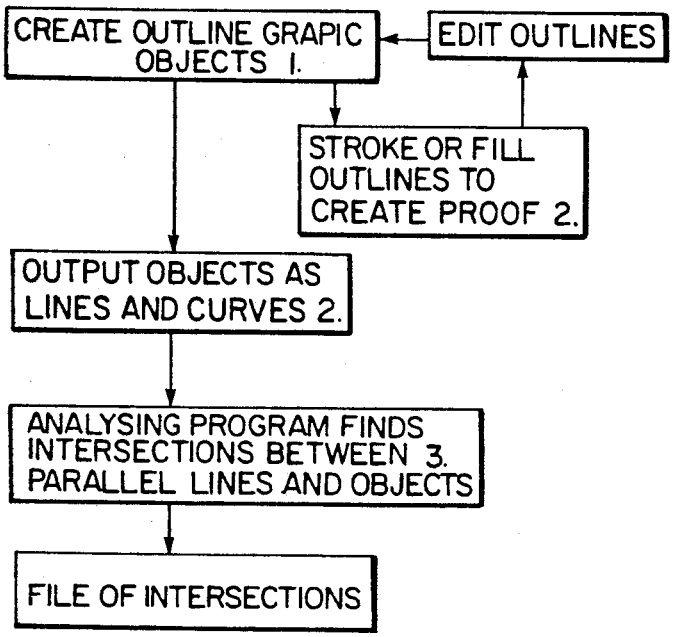

NOTES:

1. THIS CAN BE AN OUTLINE FONT OR ANY GRAPHIC OBJECTS CREATED WITH A DRAWING PROGRAM OR EXPLICITY PROGRAMMED.
2. USE OF POSTSCRIPT LANGUAGE AND INTERPRETERS CAN SIMPLIFY THESE STEPS.
3. OPTIONS TO THE ANALYSING PROGRAM INCLUDE THE LINE SPACING AND LENGTH.

B.

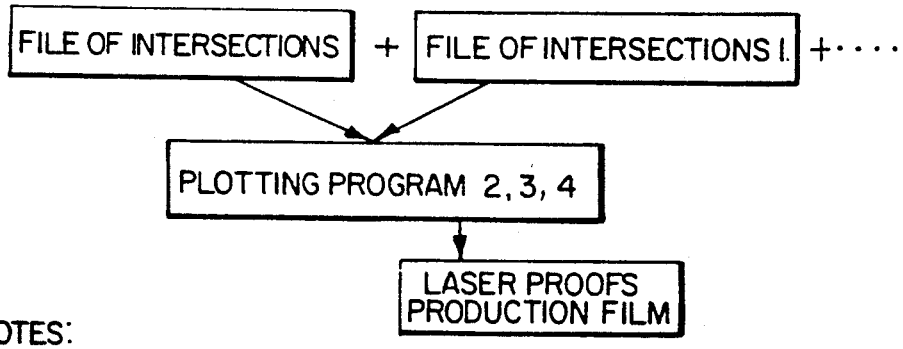

NOTES:

1. MULTIPLE FILES OF INTERSECTIONS, EACH FOR A DIFFERENT OBJECT OR SET OF OBJECTS CAN BE COMBINED TOGETHER.
2. THIS MAY CONVENIENTLY BE EXECUTED ON A POSTSCRIPT INTERPRETER WHICH ALLOWS ENLARGED PROOFING ON A LASER PRINTER AND HIGH QUALITY REAL SIZE FILM OUTPUT ON A PHOTOSETTER.
3. THE OUTPUT MAY BE AS LINES OR AS TEXT TRACKING THE LINES (CHARACTER LINES).
4. OPTIONS TO THE PLOT PROGRAM INCLUDE: THE HEIGHT OF THE SHIFT, THE SLOPE OF THE RUN-UP AND RUN-DOWN, THE CHARACTER STRING, FONT SIZE, AND FACE (WHITE OR BLACK).

FIG. 8

LATENT IMAGES COMPRISING PHASE SHIFTED MICRO PRINTING

FIELD OF THE INVENTION

The invention relates generally to the field of security printing and, more particularly, to a computer-generated printed security device comprising microscopic characters, group(s) of which are phase shifted relative to others so as to form a latent image which is macroscopically viewable with the aid of a finding screen.

BACKGROUND

The printing of latent images per se, for purposes of security or authentication, is known. For example, Canadian Patent No. 1,172,282 to Trevor Merry provides a security device comprising overlying line deflection patterns which produce different macroscopically viewable images when overlain at different positions by a finding screen. The latent image disclosed by the said Canadian patent is comprised of parallel lines, portions of which are deflected a predetermined distance in the area of the latent image to define the same. The lines are, of course, readily visible and do not themselves provide any additional security feature apart from the latent image. Thus, in order to increase the level of security provided by such a security device it was previously necessary to combine a separate security feature with the device, thereby adding printing or embossing steps to the overall process for producing the desired security document.

SUMMARY OF THE INVENTION

In accordance with the invention there is provided a security device, and method for producing the same, which itself provides two distinct security features, one at a microscopic level and the other at a macroscopic level. The security device comprises a substrate having applied thereto an array of characters. The characters are of a sufficiently small size as to appear uniform when ordinarily viewed but individually identifiable when viewed with the aid of appropriate magnification means. Group(s) of said characters are phase-shifted relative to the others in such a manner as to collectively define a latent image, the image being relatively indiscernible when the device is ordinarily viewed but discernible when viewed with the aid of a finding screen.

Preferably the array of characters comprises a plurality of lines of alphanumeric characters. The characters preferably occupy an area of less than, 0.2 square millimetres and have a density in the range of 1-3 character lines per millimeter.

Use of a dark background and light characters may be preferred. Preferably the application of the array of characters includes the use of a computer to generate the array.

SUMMARY OF THE DRAWINGS

The invention is described below with reference to the following drawings:

FIG. 1 is an enlarged illustration of a micro character array in accordance with the invention (The individual characters of the repeated message "Canadian Bank Note Microplex" actually occupying a space of about 0.18 mm square).

FIG. 8 is a flow chart diagram of the steps which are performed by a computer to generate an array of micro characters, groups of which are phase shifted relative to the others to collectively form a macroscopic image.

DETAILED DESCRIPTION OF THE INVENTION

Figure 2:
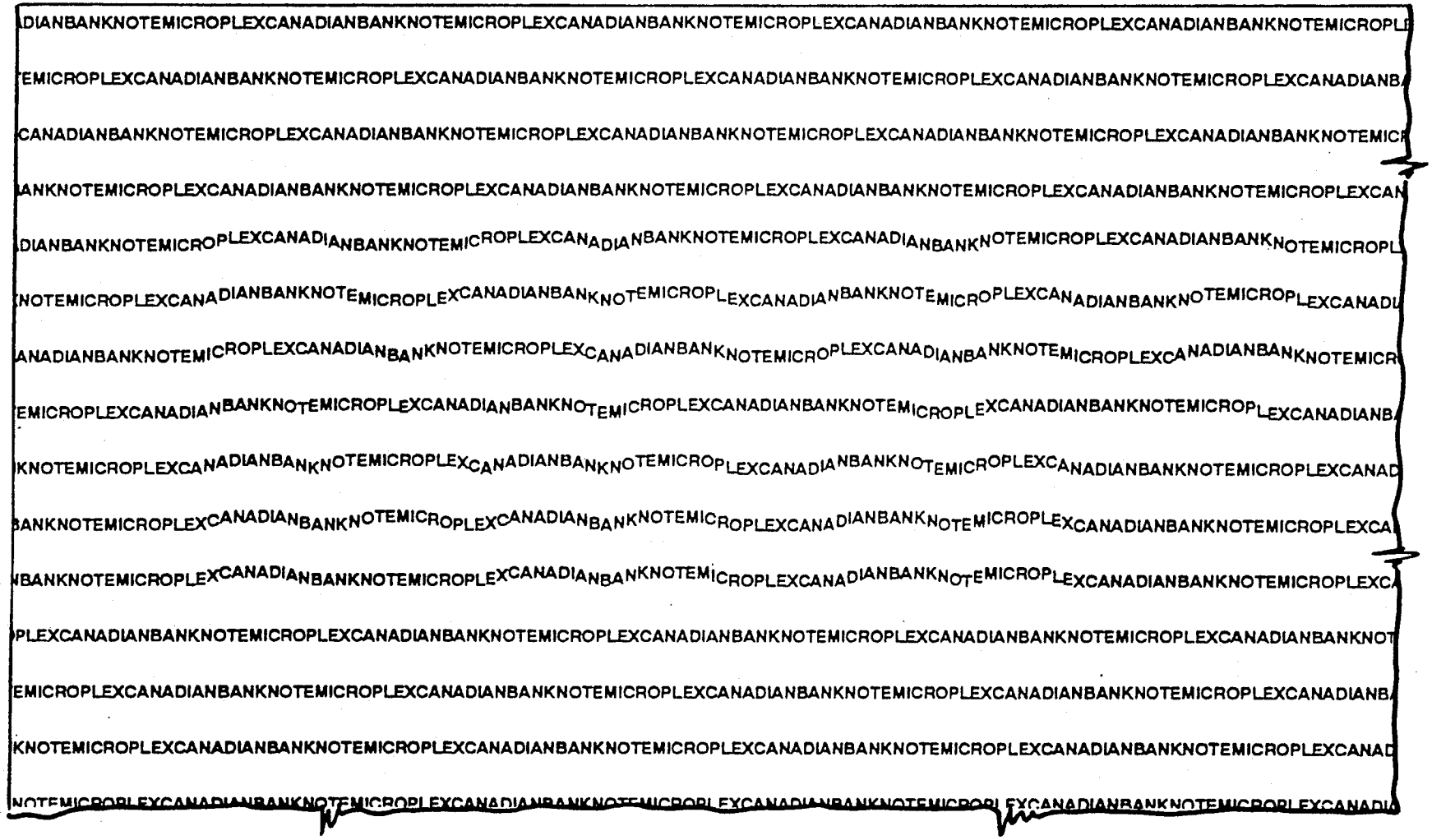
FIG. 2 is an illustration of another example of a micro character array in accordance with the invention (again, the individual characters actually occupying a space of about 0.18 mm square).

The invention is a security device comprising a pattern of microscopic characters, group(s) of which are phase-shifted relative to the others to collectively define a latent image which is macroscopically viewable with the aid of a finding screen such as a lenticular screen (described below). FIGS. 1 and 2 show examples of security devices in accordance with the invention; for purposes of illustration the printing of those figures has been substantially enlarged so that the microscopic characters may be readily viewed by the reader. However, in actuality the individual characters comprising the repeated message "CANADIAN BANK NOTE MICROPLEX" occupy a space of only about 0.18 mm square. The characters (which, alternatively, may make up any word, phrase or symbol) are spaced in lines or columns about 0.18 mm apart which results in a character density of about 2.75 character lines per millimeter. Generally, the characters preferably occupy an area of less than 0.2 mm square (i.e. 2 mm $\times$0.2 mm) and have a density in the range of 1-3 character lines per millimeter. Thus, the characters are not readily viewable and, at a macroscopic level, appear to be uniform non-distinct lines or other print elements. However, the individual characters are viewable with the aid of a microscope or suitable magnifying lens.

As illustrated by the drawings the micro characters (i.e. in the case of FIGS. 1 through 7, the letters comprising the character string "CANADIAN BANK NOTE MICROPLEX" are printed to form an array of rows (i.e. lines) and columns. Macroscopically, the character array appears generally uniform, particularly in the example shown by FIGS. 6 and 7 in which light characters appear within a dark background, but microscopically the alphanumeric characters are individually identifiable and able to convey meaningful information. Portions of the lines and columns comprising the characters are phase-shifted to collectively form larger characters or symbols, for example the letters "CBN" or "MRP" most clearly illustrated by FIGS. 4 and 5 respectively which are discernable only when the array is viewed through a finding screen. As described below, the pattern of the micro characters, including the phase-shifting, is most conveniently generated by a computer, as is the required pattern for the finding screen.

Figure 3:
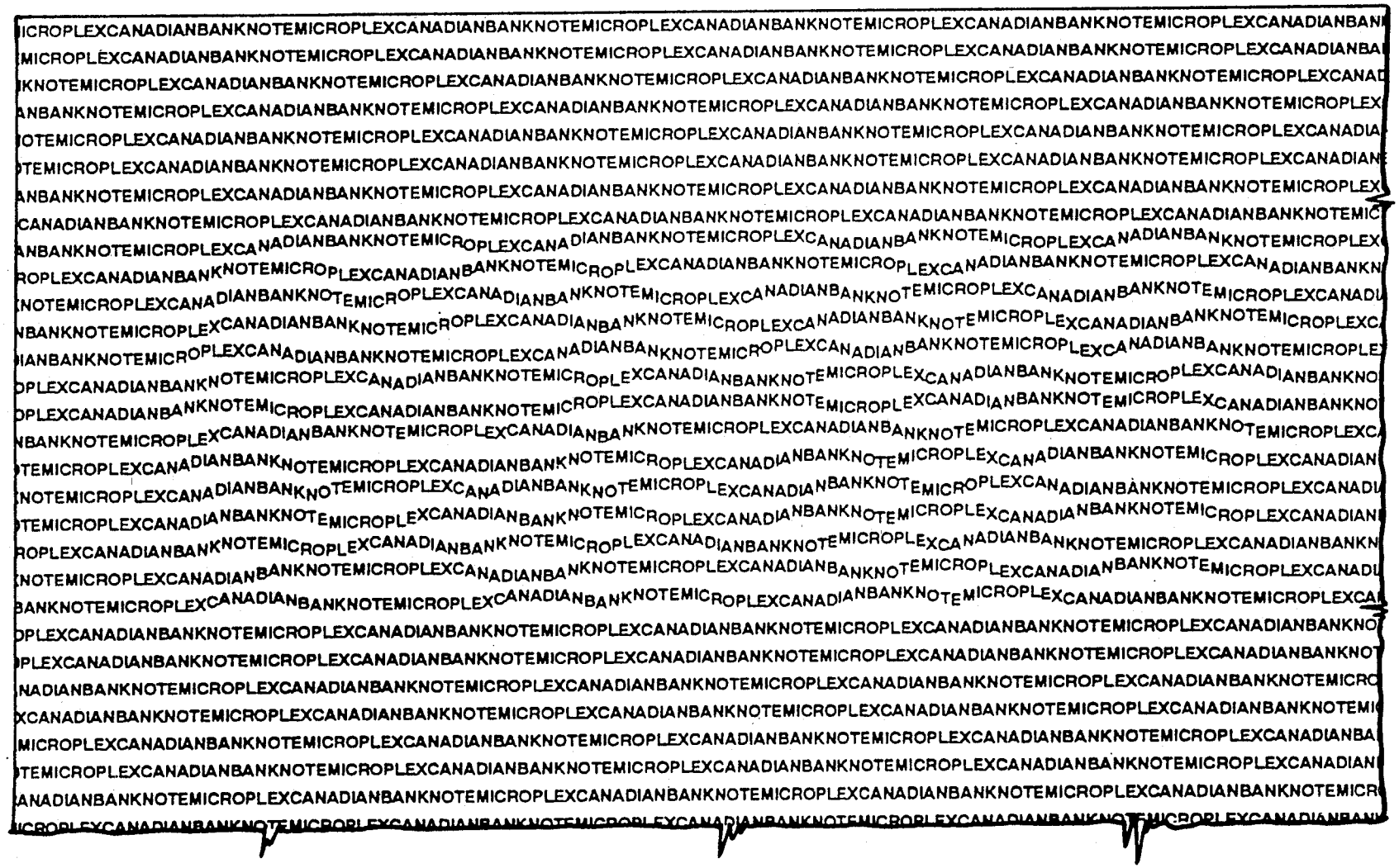
FIG. 3 is an illustration of the arrays of FIGS. 1 and 2 interlaced such that the two macroscopic images defined thereby occupy alternating lines of the characters.
Figure 4:
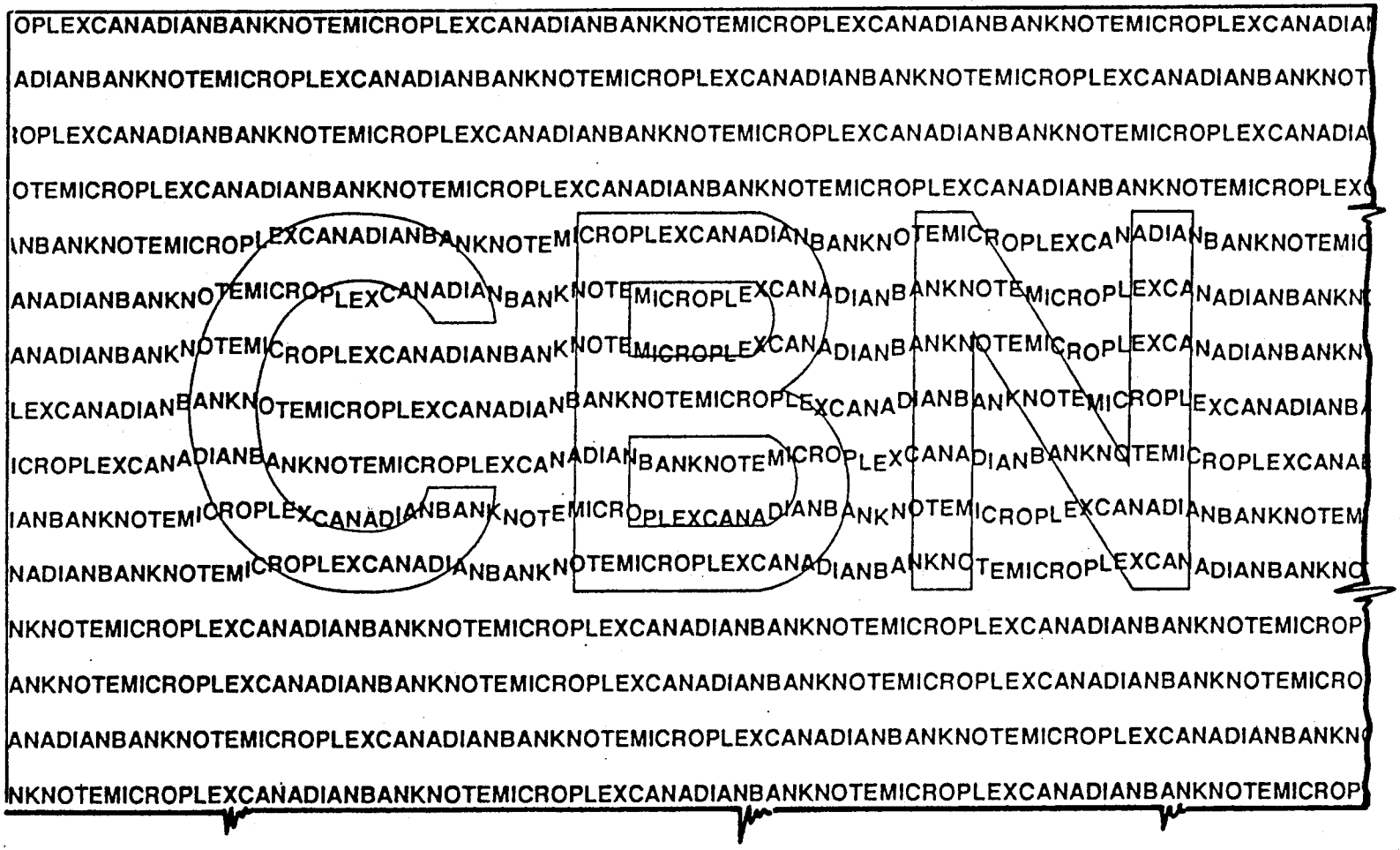
FIG. 4 is a illustration of the positioning of the macroscopic image "CBN" within a character array. (This figure has been enlarged and an outline of the macroscopic image has been superimposed on the character array in order to more clearly illustrate the invention).
Figure 5:
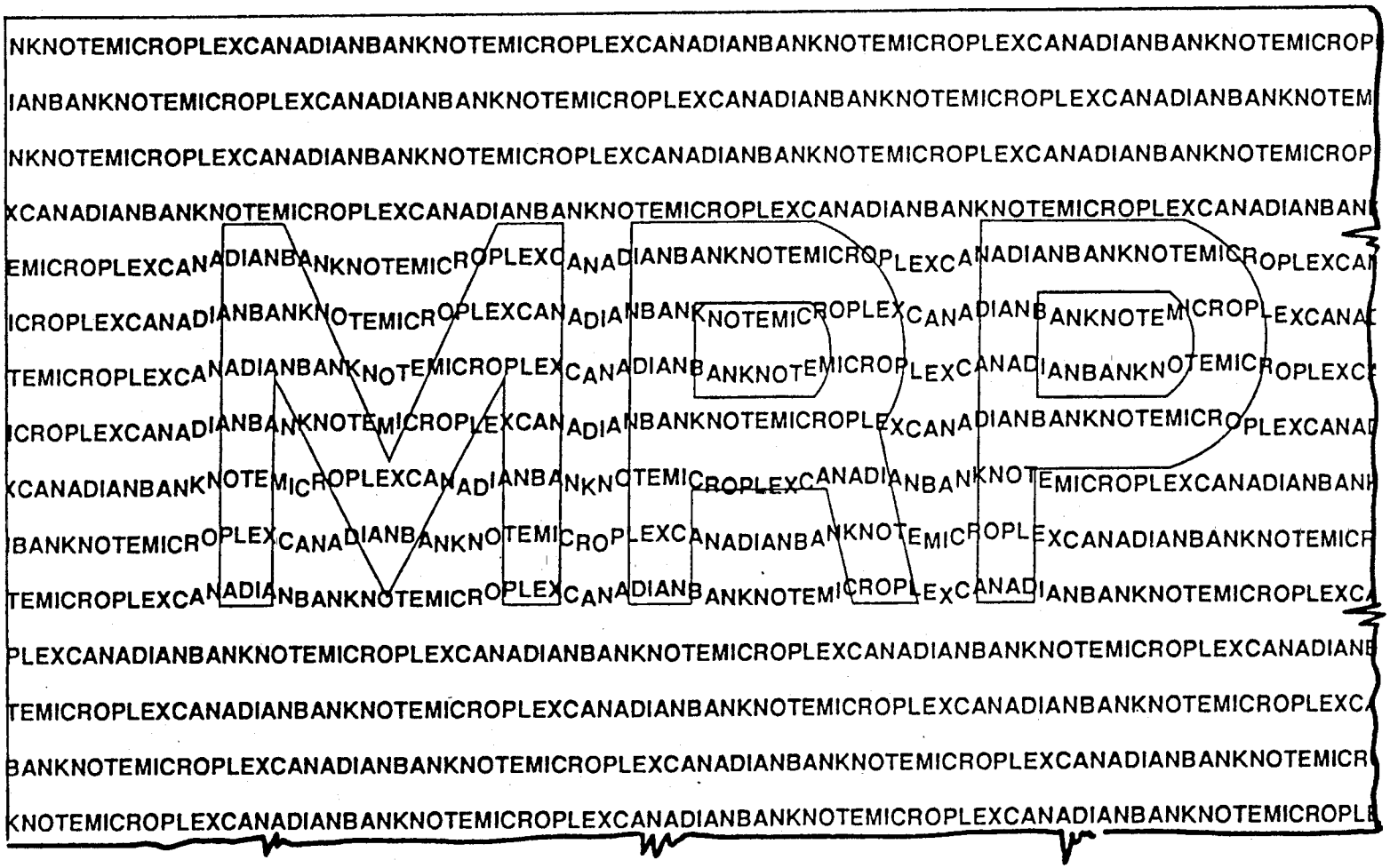
FIG. 5 illustrates an alternate macroscopic image "MRP" in similar manner to that of FIG. 4.
Figure 6:
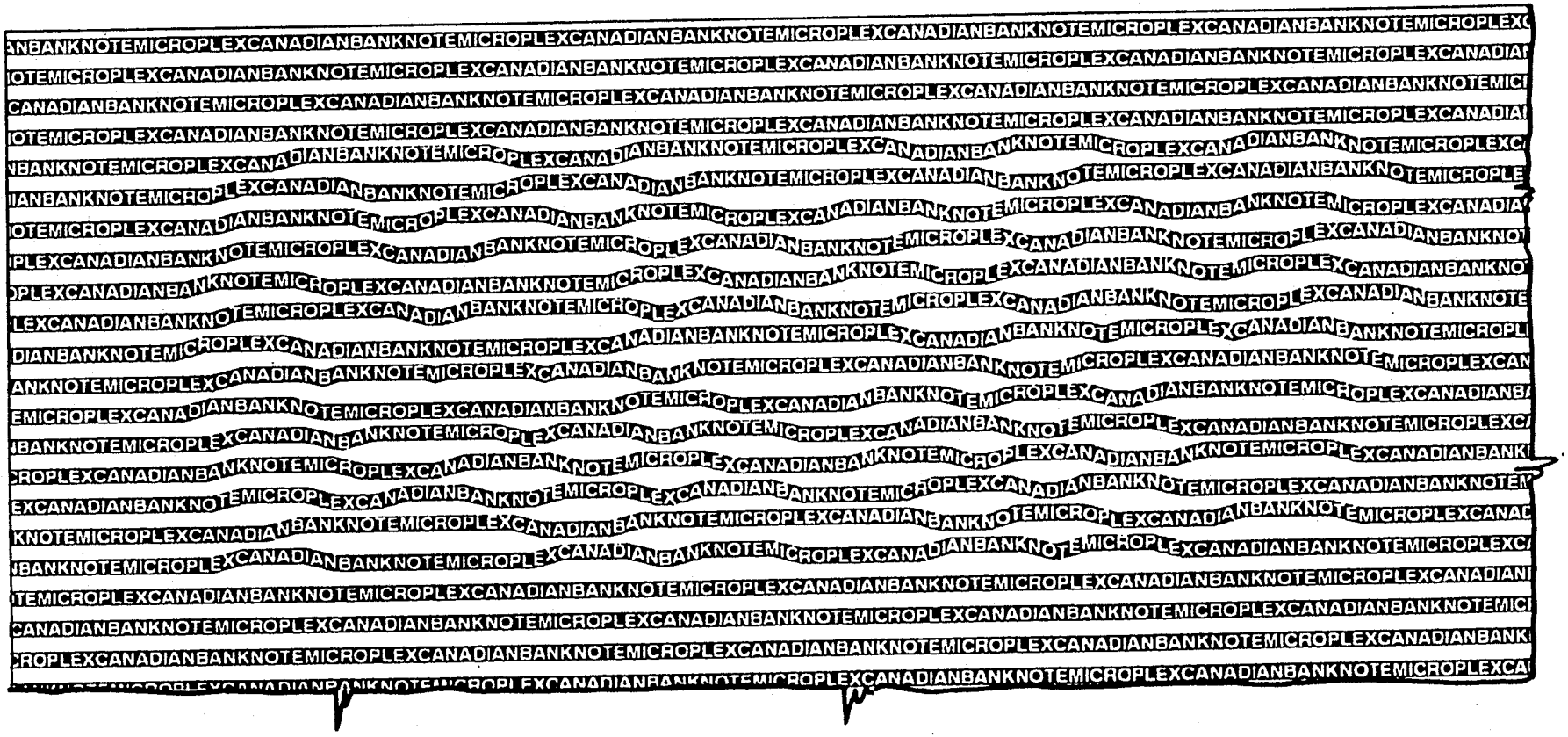
FIG. 6 is an enlarged illustration of a micro character array in accordance with another embodiment of the invention, whereby a dark background surround light characters.
Figure 7:
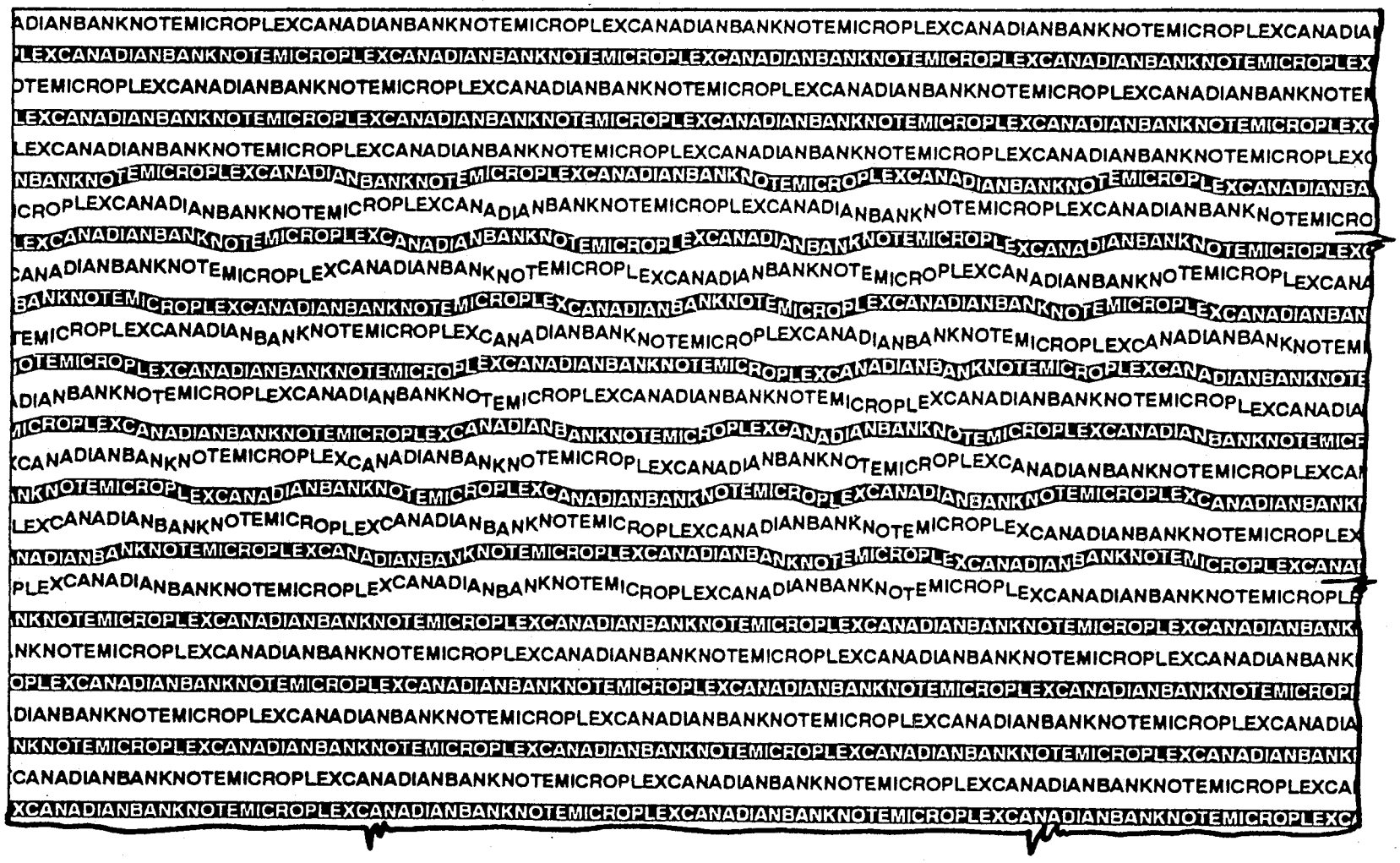
FIG. 7 is an enlarged illustration of a micro character array in accordance with another embodiment of the invention, whereby the characters and the backgrounds thereof alternate between white and black, respectively, for each successive line of characters.

The characters (or groups of characters) are shifted above or below the centerline of the character string by a distance of about one half the character height (i.e. about 0.09 mm). This phase shifting of the individual pre-selected characters is pre-arranged to, collectively, define a message comprising a word or symbol at a macroscopic level. If desired, two sets of character strings may be independently phase-shifted to macroscopically define two distinct messages as shown by FIG. 3 of the drawings. The shifting of the characters is gradual, retaining a continuum of legible information across the boundary between the background and the macroscopically viewable image. By this means, the macroscopic image is not perceived without the assistance of the viewing screen, while at the macroscopic level, integrity of the individual characters and words is maintained.

FIG. 8 provides a flow chart of a sequence of steps which are performed by a computer to generate the character arrays of FIGS. 1 through 7. Of course, many program instruction sets might be developed on the basis of the flow-chart of FIG. 8 depending upon the selected computer and output device and the specific characters and messages to be produced thereby, which are not specific to the subject matter claimed herein.

Computer-generated imaging is well known in the security printing industry and does not, per se, form any aspect of the present invention. Such imaging method provides a convenient and practical means of implementing the invention by reason of the degree of precision and control provided thereby.

The preferred methods of printing the character array are intaglio and offset lithography according to the conventional and well-known procedures in the industry. Embossing printing methods may also be appropriate where the security device is required for, for example, aluminized foil lottery tickets or where plastic laminates are used to protect identification documents.

The latent image within the printed character array, according to the foregoing, is viewable by overlaying the array with a lenticular finding screen comprising a set of convex plano-cylindrical lenses having the same line (or column) frequency as the character strings. When the lenses are aligned parallel to the character strings, the latent image is viewed at a slightly different angle than the array due to refraction. To construct the line pattern of the plano-cylindrical lenses it is convenient to generate the same by means of a computer such that a set of computer generated lines having the same frequency as the character strings can be produced on photographic film. The lines are then etched through a photo sensitive resist into a suitable substrate such as copper using a solution of ferric chloride. Each line is reproduced as a concave depression in the copper with a maximum depth of 0.15 mm. After polishing the copper mould can be used to produce screens by heating a transparent plastic material such as PLEXIGLASS (trade-mark) under pressure against the mould. The plastic flows into the depressions forming a set of convex plano-cylindrical lenses raised above a base about 1 mm thick. It will be appreciated that other lens arrays having optical characteristics matched to specific character line frequencies can be readily generated by this means.

What is claimed is:

1. A security device comprising both microscope and macroscopic hidden images, said device comprising a substrate having applied thereto an array of alphanumeric characters, said characters being of a sufficiently small size as to appear uniform when ordinarily viewed by collectively forming a microscopic image capable of conveying meaningful information when viewed with the aid of appropriate magnification means, whereby group(s) of said characters are phase-shifted relative to other said characters in such a manner as to collectively define a macroscopic image, said macroscopic image being relatively indiscernible when said device is ordinarily viewed but discernible when viewed with the aid of a finding screen.

2. A security device according to claim 1 wherein said array of alphanumeric characters comprises a plurality of lines of alphanumeric characters.

3. A security device according to claim 2 wherein said microscopic image comprises one or more words.

4. A security device according to claim 2 wherein each of said alphanumeric characters occupies an area of less than 0.2 millimeters square.

5. A security device according to claim 4 wherein the density of alphanumeric characters is in the range of 1-3 character lines per millimeter.

6. A security device according to claim 5 wherein a dark background surrounds light characters.

7. A method of making a security device comprising both macroscopic and microscopic hidden images, comprising the steps of applying to a substrate an array of alphanumeric characters, said characters being of a sufficiently small size as to appear uniform when ordinarily viewed but collectively forming a microscopic image capable of conveying meaningful information when viewed with the aid of appropriate magnification means, and positioning group(s) of said characters in phase-shifted relation relative to other said characters so as to collectively form a macroscopic image, said macroscopic image being relatively indiscernible when said device is ordinarily viewed but discernible when viewed with the aid of a finding screen.

8. A method according to claim 7 whereby said application of said array of alphanumeric characters includes the use of a computer to generate said array.

9. A method according to claim 8 wherein said array of alphanumeric characters comprises a plurality of lines of characters.

10. A method according to claim 9 wherein said microscopic image comprises one or more words.

11. A method according to claim 9 whereby each of said alphanumeric characters occupies an area of less than 0.2 millimeters square.

12. A method according to claim 11 whereby the density of said alphanumeric characters is in the range of 1-3 character lines per millimeter.

13. A method according to claim 12 whereby a dark background surrounds light characters.

* * * * *